US008007226B2

(12) United States Patent
Hazama et al.

(10) Patent No.: US 8,007,226 B2
(45) Date of Patent: Aug. 30, 2011

(54) FUEL PUMP

(75) Inventors: Tadashi Hazama, Chita-gun (JP); Eiji Iwanari, Chiryu (JP); Kenichi Tomomatsu, Kariya (JP)

(73) Assignee: Denso Corporation, Kariya (JP)

( * ) Notice: Subject to any disclaimer, the term of this patent is extended or adjusted under 35 U.S.C. 154(b) by 987 days.

(21) Appl. No.: 11/872,860

(22) Filed: Oct. 16, 2007

(65) Prior Publication Data

US 2008/0089776 A1 Apr. 17, 2008

(30) Foreign Application Priority Data

Oct. 17, 2006 (JP) ..... 2006-282122
Mar. 14, 2007 (JP) ..... 2007-064849

(51) Int. Cl.
*F04D 5/00* (2006.01)

(52) U.S. Cl. ..... 415/55.1

(58) Field of Classification Search ..... 415/55.1–55.6
See application file for complete search history.

(56) References Cited

U.S. PATENT DOCUMENTS

| | | | | |
|---|---|---|---|---|
| 4,793,766 | A * | 12/1988 | Kumata | 415/55.1 |
| 5,096,386 | A * | 3/1992 | Kassel | 417/69 |
| 5,310,308 | A | 5/1994 | Yu et al. | |
| 5,328,325 | A | 7/1994 | Strohl et al. | |
| 5,391,062 | A | 2/1995 | Yoshioka | |
| 5,449,269 | A * | 9/1995 | Frank et al. | 415/55.1 |
| 5,513,950 | A * | 5/1996 | Yu | 415/55.1 |
| 6,224,323 | B1 * | 5/2001 | Murase et al. | 415/55.1 |
| 6,425,733 | B1 * | 7/2002 | Ross | 415/55.1 |
| 6,527,505 | B2 | 3/2003 | Yu et al. | |
| 6,767,179 | B2 | 7/2004 | Kusagaya et al. | |
| 6,796,764 | B2 | 9/2004 | Motojima et al. | |
| 6,932,562 | B2 | 8/2005 | Ross | |

FOREIGN PATENT DOCUMENTS

| | | |
|---|---|---|
| JP | 4-52595 | 5/1992 |
| JP | 5-187382 | 7/1993 |
| JP | 5-508460 | 11/1993 |
| JP | 7-167081 | 7/1995 |
| JP | 09-068184 | 3/1997 |
| JP | 2003-336558 | 11/2003 |
| JP | 2004-11556 | 1/2004 |
| JP | 2005-120834 | 5/2005 |

OTHER PUBLICATIONS

Japanese Office Action dated Feb. 26, 2010, issued in corresponding Japanese Application No. 2006-282122, with English translation.
Chinese Office Action dated Mar. 6, 2009, issued in corresponding Chinese Application No. 200710162647.4, with English translation.

* cited by examiner

*Primary Examiner* — Ninh H Nguyen
(74) *Attorney, Agent, or Firm* — Nixon & Vanderhye PC

(57) ABSTRACT

A fuel pump includes a rotatable impeller having a plurality of blades and blade ditches on the periphery thereof, a motor section for driving the impeller, and a casing member which accommodates the impeller and has at least one fuel passage along an outer periphery of the impeller. The fuel passage communicates with the blade ditches. Moreover, a radially-inside inner surface of the fuel passage, with respect to an axis of rotation of the impeller, from a centerline on a bottom of the fuel passage to a radially inside edge of the fuel passage is formed as an approximately quadrant curved surface.

11 Claims, 6 Drawing Sheets

FUEL PUMP

CROSS REFERENCE TO RELATED APPLICATION

This application is based upon, claims priority from and incorporates herein by reference the contents of Japanese Patent Application No. 2006-282122 filed on Oct. 17, 2006 and No. 2007-64849 filed on Mar. 14, 2007.

FIELD OF THE INVENTION

The present invention relates to a fuel pump that supplies fuel suctioned from a fuel tank to an internal combustion engine.

BACKGROUND OF THE INVENTION

Fuel pumps that include a motor section and a pump section having an impeller that is rotated by the motor section so as to pump up and pressurize fuel from a fuel tank are well known, as disclosed in JP-A-5-187382, JP-A-5-508460, JP-A-7-167081, JP-A-2003-336558, JP-A-2005-120834 and JP-A-2004-11556.

As shown in FIG. 9, a pump section 400 includes an impeller 402, a casing cover 404, and a pump casing 406. The casing cover 404 and the pump casing 406 form a casing member, which accommodates and rotatably supports the impeller 402. The casing cover 404 has a fuel suction port (not shown), through which fuel is pumped up from the fuel tank (not shown) into fuel passages 410,411. The fuel passages 410,411 are formed as C-shaped grooves along an outer periphery of the impeller 402 in the casing cover 404 and the pump casing 406, respectively The impeller 402 is disc-shaped, and a plurality of blades and blade ditches 408,409 are alternately formed at the outer periphery of the impeller 402. When the impeller 402 rotates, fuel flows out of the blade ditches 408,409 along outside walls thereof, and flows into the fuel passages 410,411. The fuel returns to the blade ditches 408,409 from the fuel passages 410,411 along radially inside walls of the blade ditches 408,409 and flows out of the blade ditches 408,409 along the radially outside walls thereof again. After the fuel repeats the above flowing out and returning, the fuel is pressurized and forms a circulating flow 412,413, as shown in FIG. 9.

Fuel is provided considerable kinetic energy from the rotating impeller 402 in a rotation direction thereof immediately after flowing out of the blade ditches 408,409 of the impeller 402. Therefore, the component of velocity in the rotation direction of the fuel flows 412,413 is bigger. However, before the fuel in the fuel passages 410,411 returns into the blade ditches 408,409, the kinetic energy of the fuel flows 412,413 decreases because of the friction with the inner walls of the fuel passages 410,411. In other words, the component of velocity in the rotation direction of the fuel flows 412,413 is a main component of velocity in the first stage that fuel flows 412,413 in the fuel passages 410,411. On the other hand, the component of velocity in the radial direction of the fuel flows 412,413 is a main component of velocity in the later stage that fuel flows in the fuel passages 410,411. Accordingly, as fuel flows closer to the inside walls of the fuel passages 410,411 in the later stage, the flow direction of the fuel gets closer to the radial direction of the impeller 402.

As described above, when the kinetic energy of the fuel flow 412,413 decreases in the later stage, the flow direction of the fuel is forced to change largely by the radially inside walls of the fuel passages 410,411, with respect to the axis of rotation of the impeller 402, and the fuel flows into the blade ditches 408,409. As a result, the kinetic energy of the fuel flow 412,413 further decreases, that is, the pump efficiency decreases.

The efficiency of the fuel pump is expressed as the product of the motor efficiency and the pump efficiency Accordingly, when the pump efficiency improves, the efficiency of the fuel pump also improves.

SUMMARY OF THE INVENTION

It is an object of the present invention to provide an improved fuel pump that has a high pump efficiency.

According to the present invention, a fuel pump includes a rotatable impeller having a plurality of blades and blade ditches on the periphery thereof, a motor section for driving the impeller, and a casing member which accommodates the impeller and has at least one fuel passage along an outer periphery of the impeller. The fuel passage communicates with the blade ditches. Moreover, a radially-inside inner surface of the fuel passage from a centerline on a bottom of the fuel passage to an radially inside edge of the fuel passage is formed as an approximately quadrant curved surface.

Alternatively, in the case that a fuel pump has two fuel passages disposed axially on both sides of the impeller, an outside diameter D of the impeller and a thickness t of the impeller are set to satisfy the condition expression that the value of (D/t) is equal to or less than 8.4, and distances L1, L2 from the center of the impeller with respect to the thickness direction to the bottoms of the fuel passages and the thickness t of the impeller are set to satisfy the condition expression that the value of (t/2) is equal to or more than both (L1)/2 and (L2)/2

BRIEF DESCRIPTION OF THE DRAWINGS

The above and other objects, features and advantages of the present invention will become more apparent from the following detailed description with reference to the accompanying drawings. In the drawings.

DETAILED DESCRIPTION OF THE PREFERRED EMBODIMENTS

First Embodiment

Figure 1:
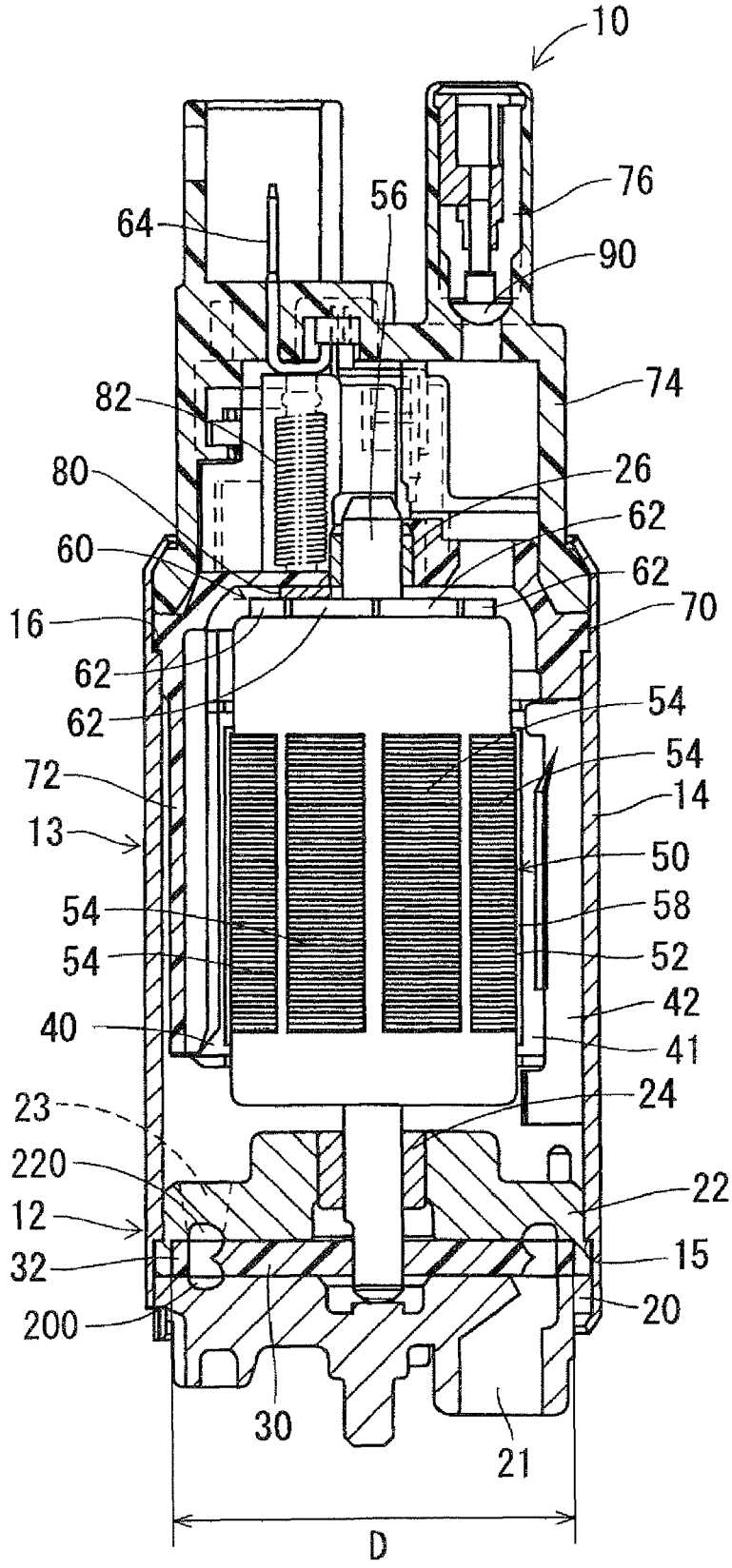
FIG. 1 is a longitudinal cross-sectional view showing a fuel pump according to a first embodiment of the present invention.

A fuel pump 10 according to the first embodiment will be described with reference to FIGS. 1-3.

The fuel pump 10 is an in-tank type turbine pump that is usually accommodated in a fuel tank (not shown) of a vehicle, such as two-wheel vehicle or four-wheel vehicle. The fuel pump 10 pressurizes fuel suctioned from the fuel tank, and supplies the pressurized fuel to an internal combustion engine.

The fuel pump 10 includes a pump section 12 and a motor section 13 that drives the pump section 12. The pump section 12 and the motor section 13 are housed in a housing 14. A casing cover 20 is caulked at the outer periphery thereof by the edge portion of the housing 14. With this structure, the pump casing 22 can be held between the casing cover 20 and a step 15 formed on the inner surface of the housing 14.

The pump section 12 is a turbine pump that includes the casing cover 20, a pump casing 22 and an impeller 30. The pump section 12 is arranged on the upstream side of the motor section 13 in the axial direction of the rotation axis of an armature 50 of the motor section 13. The impeller 30 (as a rotating member) is assembled on a rotary shaft 56 (as a rotation axis). The casing cover 20 and the pump casing 22 form a casing member, which accommodates and rotatably supports the impeller 30. The casing cover 20 has a fuel suction port 21, through which fuel is pumped up from the fuel tank into fuel passages 200,220. The fuel passages 200, 220 are formed as C-shaped grooves along an outer periphery of the impeller 30 in the casing cover 20 and the pump casing 22, respectively.

The impeller 30 is disc-shaped, and has a body 31, an annular portion 32, blades 33, blade ditches 34,35 and partition walls 37. A plurality of blades 33 and blade ditches 34,35 are formed alternately at the outer periphery thereof. The annular portion 32 is positioned outside of the blades 33 and blade ditches 34,35 and is connected the outer edge of the blades 33. The blades 33 are folded nearly at the central portion with respect to the axial direction of the impeller 30 so that the central portion of the blades 33 are positioned anterior to both ends of the blades 33 in the rotation direction of the impeller 30. With this structure, the fuel passages 200,220 communicate with the blade ditches 34,35, respectively.

Figure 2:
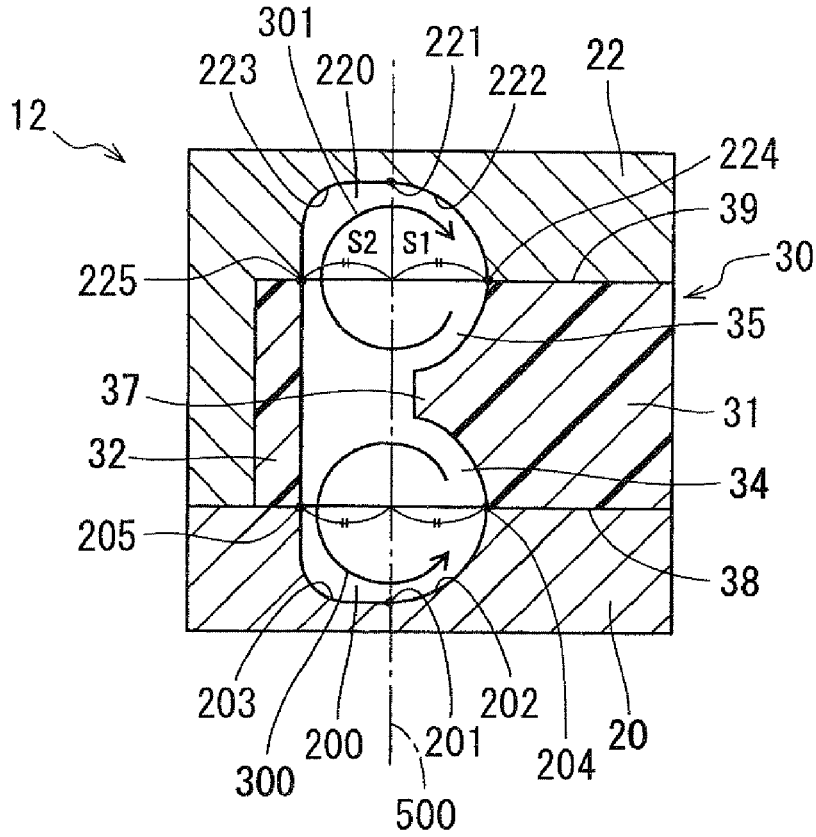
FIG. 2 is an enlarged cross-sectional view of a portion around fuel passages of the fuel pump shown in FIG. 1.
Figure 3A:
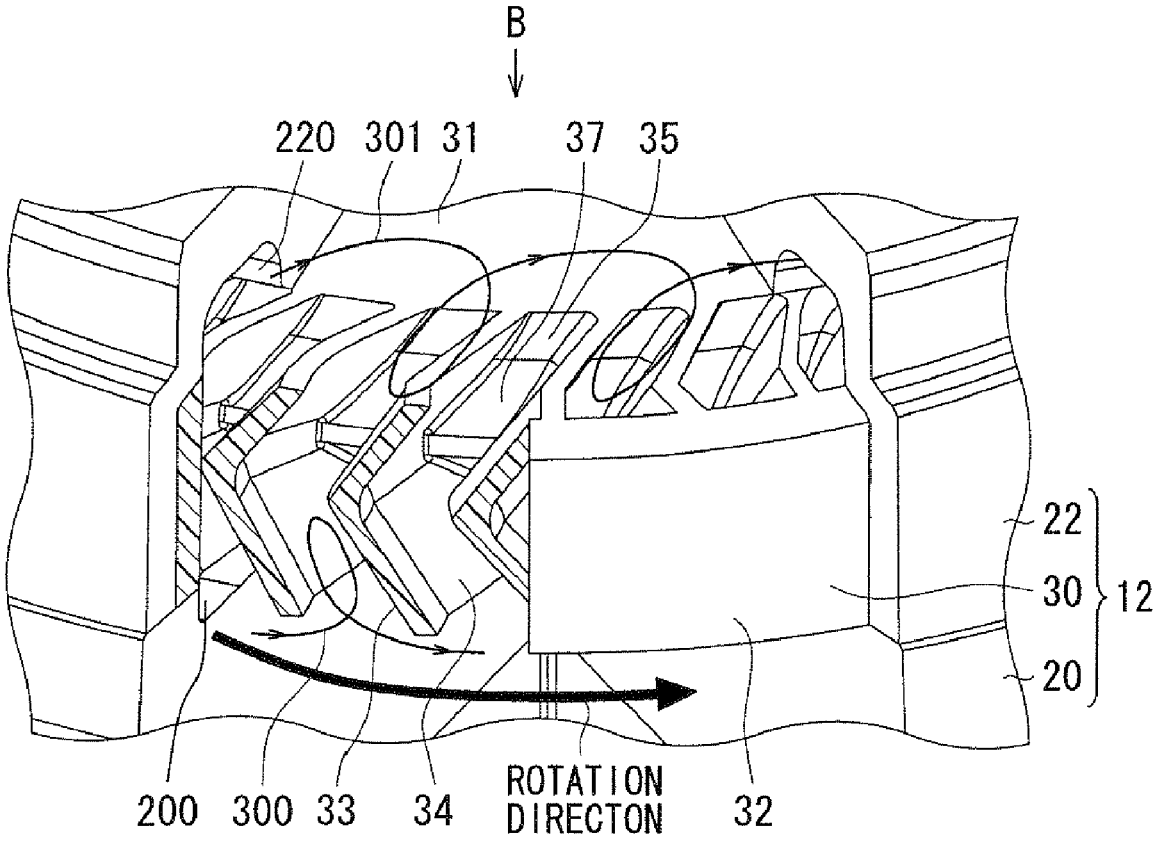
FIG. 3A is a perspective, cross-sectional view showing a pump section of the fuel pump shown in FIG. 1.
Figure 3B:
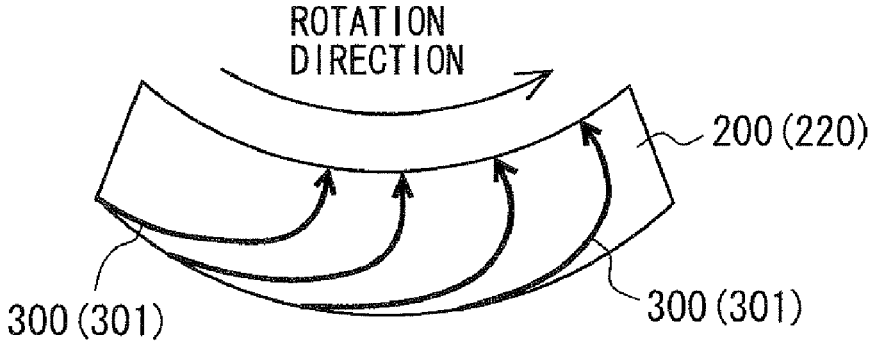
FIG. 3B is a top view from the direction B in FIG. 3A, showing fuel flow in the pump section.

The partition walls 37 are extended from the body 31 along folded portion of the blades 33, and are disposed partially in a body-side space between the neighbor blades 33, as shown in FIGS. 2 and 3A. Moreover, the partition walls 37 have smoothly curved surfaces so as to form a circulating flow in the blade ditches 34. With this structure, the blade ditches 34,35 are axially formed on both sides of the partition walls 37, respectively. Specifically, the blade ditches 34 are formed on the cover-side of the partition walls 371 and the blade ditches 35 are formed on the casing-side of the partition walls 37.

When the impeller 30 rotates with the rotary shaft 56 by rotating the armature 50 of the motor section 13, fuel flows out of the blade ditches 34,35 of the impeller 30 toward the inner surface of the fuel passages 200,220. The fuel returns into the blade ditches 34,35 from the inner surface of the fuel passages 200,220 and flows out of the blade ditches 34,35 of the impeller 30 again After the fuel repeats the above flowing out and returning, the fuel is pressurized and forms circulating flows 300,301 in the fuel passages 200,220. Thus, fuel can be pumped up through the fuel suction port 21 and be pressurized in the fuel passages 200,220 by the rotating impeller 30. Fuel pressurized in the fuel passages 200,220 flows together in a discharge port 23 of the pump casing 22, and is discharged into the motor section 13 through the discharge port 23.

The motor section 13 includes permanent magnets 40,41, the armature 50, a commutator 60, a brush 80 and a choke coil 82. Permanent magnets 40,41 have arc-shaped cross-sections respectively, and are fixed on the inner surface of the housing 14 with adhesive at equal intervals, so that S-pole and N-pole are positioned. Accordingly, two gaps are formed between edge faces of the permanent magnets 40,41 that are disposed in the circumferential direction of the housing 14. A plate spring 42 is disposed in one gap and a support member 72 of a bearing holder 70, which extends toward the pump section 12, is disposed in another gap. The plate spring 42 and the support member 72 can prevent permanent magnets 40,41 from shifting in the circumferential direction.

The armature 50 is rotatably positioned inside two permanent magnets 40,41 so that a clearance space is formed as a fuel passage 58 between inner surfaces of the permanent magnets 40,41 and an outer surface of the armature 50. The armature 50 has a core 52 that is made of the laminated magnetic steel sheets, and coils wound around the core 52. The core 52 has a plurality of magnetic pole cores 54 which are arranged in the rotation direction of the armature 50. The coils are wound around each of the magnetic pole cores 54. Moreover, the rotary shaft 56 is inserted into a core 52. A metal bearing 24 rotatably supports one end of the rotary shaft 56, and a metal bearing 26 rotatably supports the other end of the rotary shaft 56. The bearing 24 is disposed in the pump casing 22, and the bearing 26 is disposed in the bearing holder 70.

The commutator 60 is formed as a plane disk-shape, and is disposed on the opposite side of the impeller 30 with respect to the armature 50. The commutator 60 has a plurality of segments 62 which are arranged in the rotation direction of the armature 50. The segments 62 are made of carbon, for example, and electrically connected to the coils of the armature 50. The adjacent segments 62 are separated by a gap or an insulating resin. This prevents the adjacent segments 62 from connecting electrically. With this structure, when the armature 50 rotates, each segment 62 will make contact with the brush 80 sequentially, and drive current to be supplied to the coils of the armature 50 will be commutated. A terminal 64 is inserted in an end cover 74. Drive current is supplied to the coils of the armature 50 from an external power source through the terminal 64, the brush 80, and the commutator 60. The end cover 74 is caulked at the outer periphery thereof by the edge portion of the housing 14, as shown in FIG. 1. With this structure, the bearing holder 70 can be held between the end cover 74 and a step 16 formed on the inner surface of the housing 14. A discharge port 76 is disposed on the end cover 74, and accommodates a check valve 90 for preventing backflow of fuel discharged from the discharge port 76. The bearing holder 70 and the end cover 74 are made of resin.

With the above-described structure, fuel discharged from the discharge port 23 of the pump section 12 will be supplied to the internal combustion engine through the gaps between edge faces of permanent magnets 40,41, the fuel passage 58 and the discharge port 76. Thus, fuel pressurized in the pump section 12 flows in the motor section 13. Accordingly, the fuel flowing in the motor section 13 cools the motor section 13, and improves the lubricity of a slide member in the motor section 13.

According to the present invention, each radially-inside inner surface of the fuel passages 200,220 from centerlines 201,221 on the bottoms of the fuel passages 200,220 to radially inside edges 204,224 of the fuel passages 200,220 is formed as an approximately quadrant curved surface.

In a first embodiment, continuously curved surfaces 202, 203,222,223 are formed at the bottom side of each sidewall of the fuel passages 200,220. With this structure, distances from centerlines 201,221 on the bottoms of fuel passages 200,220 to radially inside edges 204,224 through said inside curved surfaces 202,222 are shorter than distances from centerlines 201,221 to radially outside edges 205,225 through said outside curved surfaces 203,223, as shown in FIG. 2. The curvature radius of the inside curved surfaces 202,222 are longer than that of the outside curved surfaces 203,223. In other words, inside curved surfaces 202,222 are curved more gently than the outside curved surfaces 203,223. The sidewalls of fuel passages 200,220 are orthogonal to outer surfaces 38,39 of the impeller 30 at the radially inside edges 204,224 of the fuel passages 200,220. With this structure, the outside cross section area S2 of the fuel passages 200,220, which is the cross section area of the outside of the imaginary plane 500 connecting the centerlines 201,221, is larger than the inside cross section S1 of the Fuel passages 200,220, which is the cross section area of the inside of the imaginary plane 500, as shown in FIG. 2.

In the first embodiment, fuel flows out of a front blade ditches 34,35 into the fuel passages 200,220, and flows into another rear blade ditches 34,35 from the fuel passages 200, 220 with respect to the rotation direction of the impeller 30. Fuel is provided high kinetic energy in the rotation direction of the impeller 30 from the rotating impeller 30 immediately after flowing out of the blade ditches 34,35. Therefore, the component of velocity in the rotation direction of fuel flows 300,301 is bigger. Accordingly, each fuel in the fuel passages 200,220 flows in the nearly rotation direction of the impeller 30 immediately after flowing out of the blade ditches 34,35.

However, before the fuel flowing in the fuel passages 200, 220 returns into the blade ditches 34,35 from the fuel passages 200,220, each kinetic energy of the fuel flow 300,301 decreases because of the friction with the inner wall of the fuel passages 200,220. In other words, the component of velocity in the rotation direction is a main component of velocity in the first stage of the fuel flowing in the fuel passages 200,220. On the other hand, the component of velocity in the radial direction is a main component of velocity in the later stage of the fuel flowing in the fuel passages 200,220. Accordingly, as fuel flows closer to the inside wall of the fuel passage 200,220 in the later stage, the flow direction of the fuel gets closer to the radial direction of the impeller 30.

In the first embodiment, smoothly curved surfaces 202, 203,222,223 are formed at the bottom side of the sidewall of the fuel passages 200,220. Moreover, the curvature radius of the inside curved surfaces 202,222 are longer than that of the outside curved surfaces 203,223. In other words, inside curved surfaces 202,222 are curved more gently than the outside curved surfaces 203,223. More specifically, each of the radially-inside inner surface of the fuel passages 200,220 from a centerlines 201,221 on bottoms of the fuel passages 200,220 to radially inside edges 204,224 of the fuel passages 200,220 is formed as an approximately quadrant curved surface. With this structure, the flow direction of fuel is forced to change gradually along the inner surfaces of the inside area of the fuel passages 200,220. This reduces the decrease in kinetic energy of the fuel flows 300,301. Therefore, the efficiency of fuel pressurized in the fuel passages 200,220, the pump efficiency in the pump section 12, is improved.

In the first embodiment, the outside cross section area S2 of the fuel passages 200,220 is larger than the inside cross section area S1 of the fuel passage 200,220. This prevents the decrease in the cross section area of the fuel passages 200, 220, that is, the decrease in the amount of fuel flowing in the fuel passages 200,220.

In the first embodiment, the sidewalls of fuel passages 200,220 are orthogonal to outer surfaces 38,39 of the impeller 30 at the radially inside edges 204,224 of the fuel passages 200,220. Accordingly, fuel flows smoothly from the fuel passages 200,220 into the blade ditches 34,35.

Incidentally, in the first embodiment, the inside curved surfaces 202,222 are formed as quadrant curved surfaces. In other words, each curvature of inside curved surfaces 202,222 is constant. However, the curvature of either of the inside curved surfaces 202,222 may be varied Also, rather than being continuously curved they may be defined by a plurality of straight segments that together define a generally quadrant curve.

Second Embodiment

A fuel pump according to the second embodiment will be described with reference to FIG. 4. The same or similar reference numerals hereafter indicate the same or substantially the same part, portion or component as the first embodiment.

Figure 4:
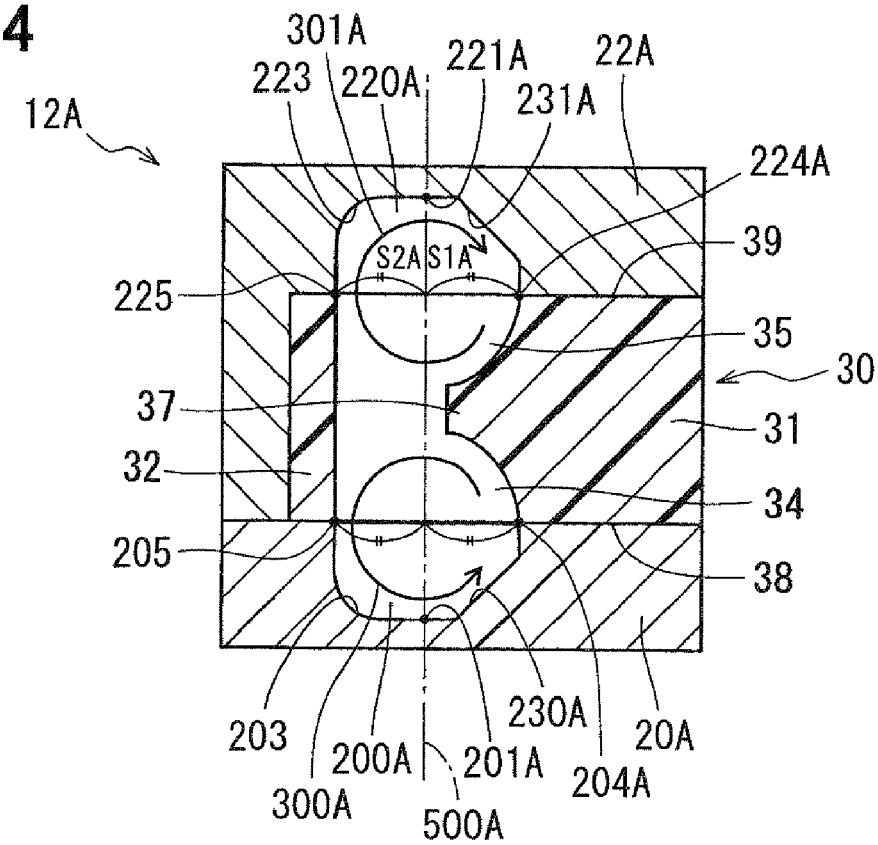
FIG. 4 is an enlarged cross-sectional view of a portion around fuel passages of the fuel pump according to a second embodiment of the present invention.

As shown in FIG. 4, inclined planes 230A,231A are formed at the bottom side of the radially inside sidewalls of fuel passages 200A,220A. With this structure in a pump section 12A, distances from centerlines 201A,221A on the bottoms of fuel passages 200A,220A to radially inside edges 204A,224A through inclined planes 230A,231A are shorter than ones from centerlines 201A,221A to radially outside edges 205,225 through outside curved surfaces 203,223. In other words, each cross section of the fuel passages 200A, 220A is asymmetrically-shaped with respect to an imaginary line 500A connecting the centerlines 201A,221A. With this structure, each of the radially-inside inner surface of the fuel passages 200A,220A from centerlines 201A,221A on bottoms of the fuel passages 200A,220A to radially inside edges 205,225 of the fuel passages 200A,220A is formed as an approximately quadrant curved surface. Moreover, each outside cross section S2A of the fuel passages 200A,220A is larger than each inside cross section S1A of the fuel passages 200A,220A, similar to the pump section 12 described in the first embodiments. Furthermore, the radially inside sidewalls of fuel passages 200A,220A are orthogonal to outer surfaces 38,39 of impeller 30 at the radially inside edges 204,224. Accordingly, the fuel pump described in the second embodiment has the same advantage as the one described in the first embodiment.

Third Embodiment

A fuel pump according to the third embodiment will be described with reference to FIG. 5.

Figure 5:
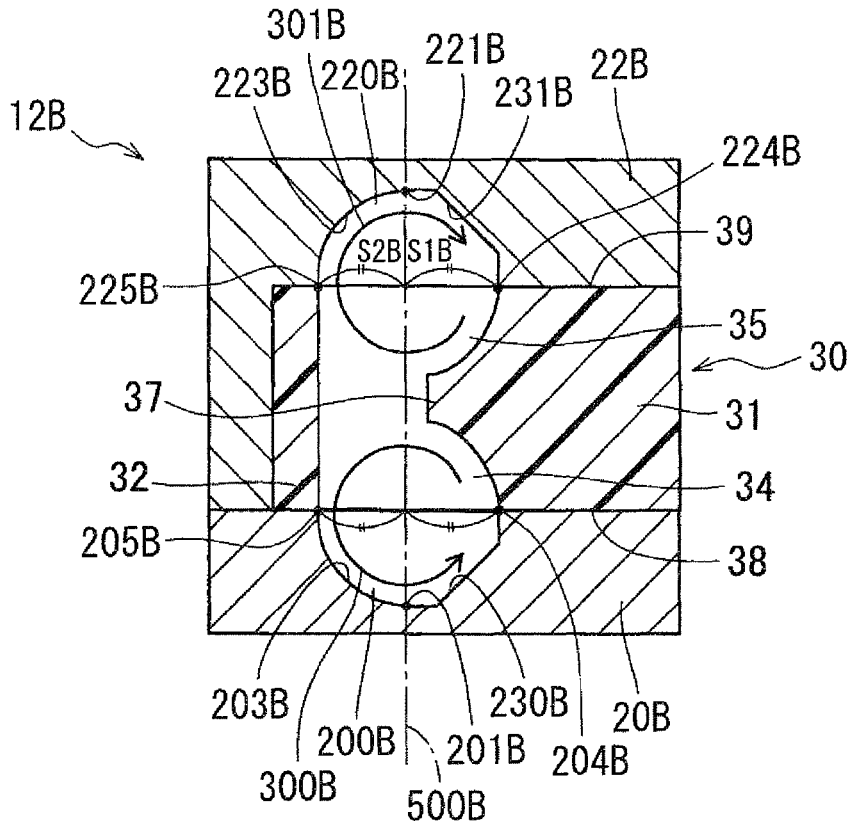
FIG. 5 is an enlarged cross-sectional view of a portion around fuel passages of the fuel pump according to a third embodiment of the present invention.

As shown in FIG. 5, inclined planes 230B,231B are formed at the bottom side of the radially inside sidewall of fuel passages 200B,220B, similar to the pump section 12A described in the second embodiment. On the other hand, quadrant curved surfaces are formed at the bottom side of the radially outside sidewalls of the fuel passages 200B,220B. With this structure, distances from centerlines 201B,221B on the bottoms of fuel passages 200B,220B to radially inside edges 204B,2243 of fuel passages 200B,220B through inclined planes 230B,231B are shorter than ones from centerlines 201B,221B to radially outside edges 205B,225B of the fuel passages 200B,220B through outside curved surfaces 203B,223B. Moreover, each outside cross section S2B of the fuel passages 200B,220B is larger than each inside cross section SIB of the fuel passages 200B,220B, similar to the pump section 12 described in the first embodiment. Furthermore, the radially inside sidewalls of fuel passages 200B, 220B are orthogonal to outer surfaces 38,39 of impeller 30 at the radially inside edges 204B,224B. Accordingly, the fuel pump described in the third embodiment has the same advantage as the ones described in the first and second embodiments.

Fourth Embodiment

A fuel pump according to the fourth embodiment will be described with reference to FIG. 6.

Figure 6:
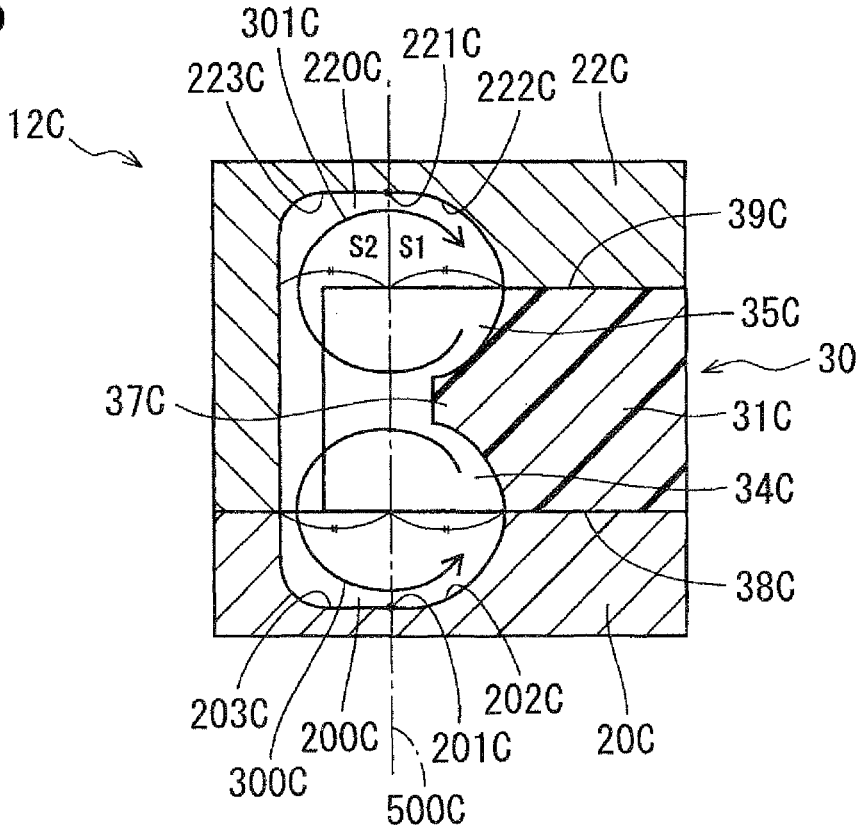
FIG. 6 is an enlarged cross-sectional view of a portion around fuel passages of the fuel pump according to a fourth embodiment of the present invention.

As shown in FIG. 6, an impeller 30C does not have an annular portion corresponding to the annular portion 32 described in the above embodiments. The other structural features are the same as the ones described in the first embodiment. According to this structure, the fuel pump in the fourth embodiment has the same advantage as the one described in the first embodiment.

Fifth Embodiment

As noted above, the efficiency of the fuel pump is expressed as the product of the motor efficiency and the pump efficiency. Accordingly, when the pump efficiency improves, the efficiency of the fuel pump also improves.

The motor efficiency Meff, the pump efficiency Peff and the efficiency of the fuel pump Feff are respectively expressed as follows:

$$Meff=(T\times N)/(I\times V)$$

$$Peff=(P\times Q)/(T\times N)$$

$$Feff=Meff\times Peff=(P\times Q)/(I\times V)$$

wherein: I is a driving current supplied to the motor section, V is a voltage applied to the motor section, T is a torque of the motor section, N is a rotation speed of the motor section, P is a pressure of fuel discharged from the fuel pump, and Q is an amount of fuel discharged from the fuel pump.

Figure 7A:
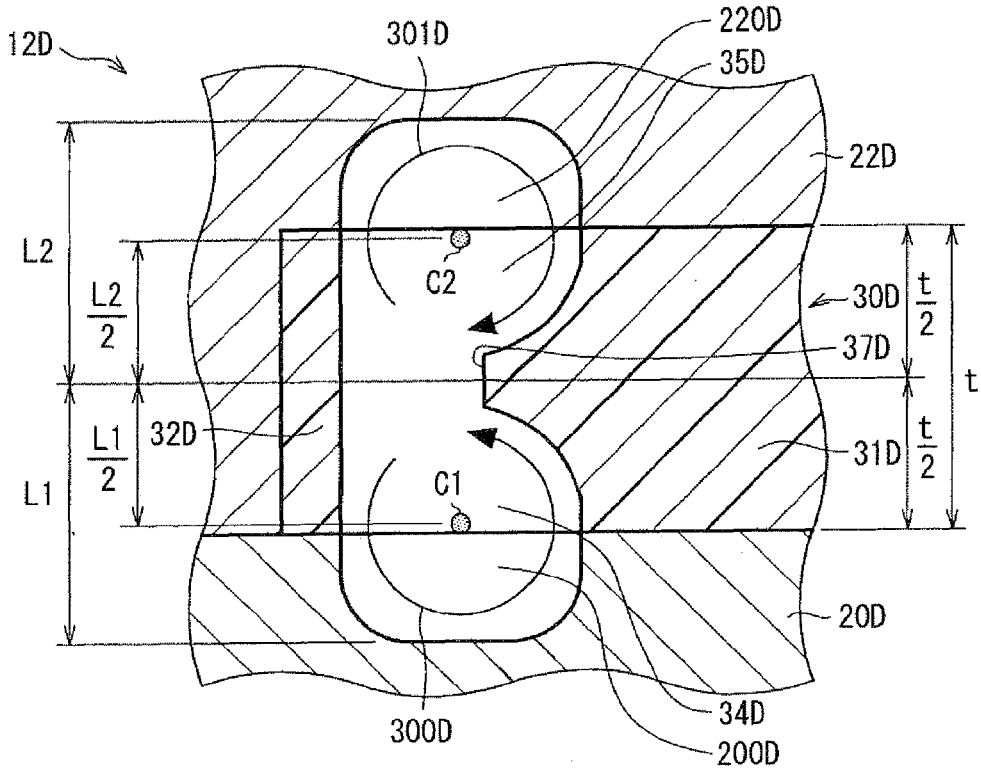
FIG. 7A is an enlarged cross-sectional view of a portion around fuel passages of the fuel pump according to a fifth embodiment of the present invention.
Figure 7B:
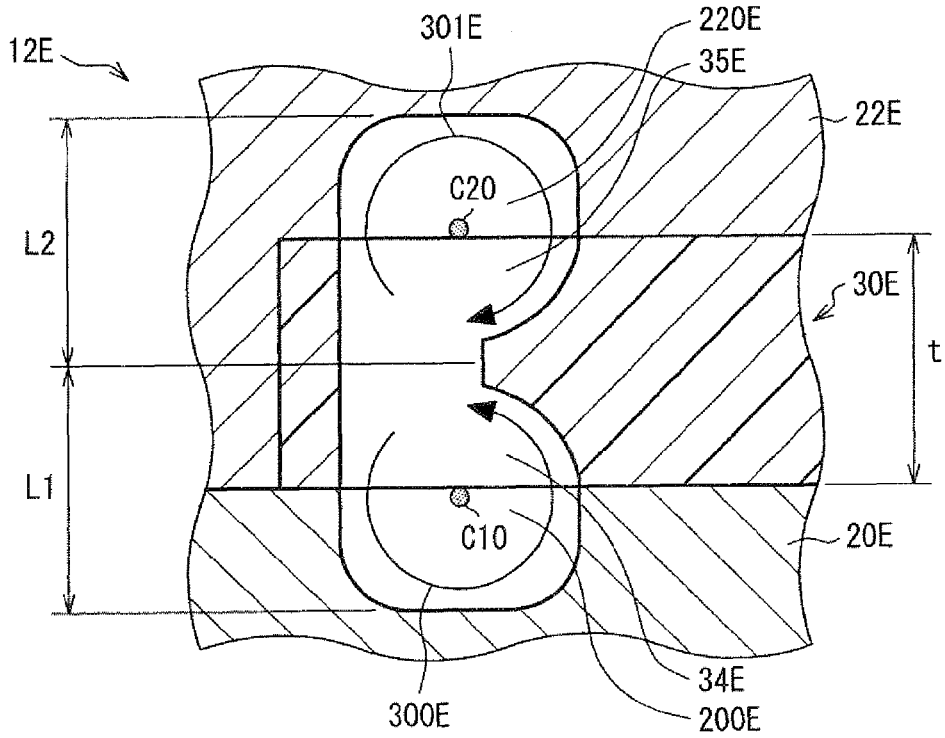
FIG. 7B is an enlarged cross-sectional view of a portion around fuel passages of a prototype fuel pump.
Figure 9:
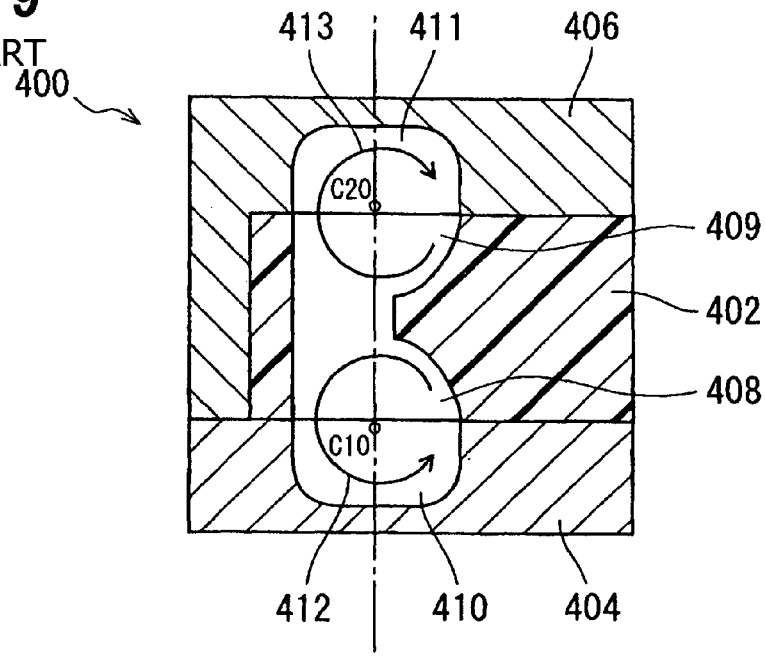
FIG. 9 PRIOR ART
FIG. 9 is an enlarged cross-sectional view of a portion around fuel passages of a conventional fuel pump.

In addition, the amount Q of discharged fuel is expressed as the product of a cross section S of the fuel passage and a flow velocity v0 of the fuel. In the case discussed with reference to FIG. 9, the cross section S is the total cross section of both fuel passages 410,411. Accordingly, when either the flow velocity v0 or the cross section S increases, the amount Q of discharged fuel increases. When a rotating velocity of the impeller 402 increases, the flow velocity v0 also increases However, the increase in the flow velocity v0 causes noise or vibration of the fuel pump and hard abrasion of the slide member in the pump section 400 and the motor section. Therefore, inventors of the present invention produced a prototype fuel pump having fuel passages whose cross section S are enlarged, and analyzed the fuel flow and the discharge efficiency of the prototype fuel pump. The result of the analysis is as follows:

As shown in FIG. 7B, with the structure of the prototype fuel pump, the cover-side axis C10 of rotation in the circulating fuel flow 300E (corresponding to the circulating fuel flow 412 shown in FIG. 9) and the casing-side axis C20 of rotation of the circulating fuel flow 301E (corresponding to the circulating fuel flow 413 shown in FIG. 9) are positioned outside of the blade ditches 34E,35E (corresponding to the blade ditches 408,409 shown in FIG. 9). In this case, even if each axis C10, C20 of rotation is positioned slightly outside of the blade ditches 34E,35E, the torque of the impeller 30E (corresponding to the impeller 402 shown in FIG. 9) is not transmitted sufficiently to fuel in the blade ditches 34E,35E. As a result, the discharge efficiency of the fuel pump becomes drastically less.

A fuel pump according to the fifth embodiment will now be described with reference to FIGS. 1, 7 and 8

In the fifth embodiment, the outside diameter D (shown in FIG. 1) of the impeller is approximately 34 mm, and the thickness t (shown in FIG. 1) of the impeller is equal to or more than approximately 4.0 mm. In other words, the thickness t is set to satisfy the condition expression that the value of D/t is equal to or less than approximately 8.4.

As shown in FIG. 7A, labeling the distance from the center of an impeller 30D with respect to the thickness direction to the bottom of the fuel passages 200D,220D as L1, L2, respectively, the value of t/2 is set to be equal to or more than both (L1)/2 and (L2)/2 With this structure, the cover-side axis C1 of circulating flow 300D is positioned (L1)/2 away from the axial center of impeller 30D in the direction of its thickness. Similarly, the casing-side axis C2 of circulating flow 301D is positioned (L2)/2 away from the axial center of impeller 30D in the direction of its thickness. Accordingly, the cover-side axis C1 and the casing-side axis C2 are positioned within blade ditches 34D,350, as shown in FIG. 7A.

Incidentally, when the impeller 30D is resin molded, mold of the portion corresponding to the blade ditches 34D,35D is demolded in the thickness direction of the impeller 30D. In this case, the cover-side mold for molding the fuel passage 200D and the casing-side mold for molding the fuel passage 220D are mutually butted at the region corresponding to the edge of the partition wall 37D. The thickness of the edge of the partition wall 37D is much smaller than the thickness t of the impeller 30D (e.g. 0.2-0.3 mm).

Figure 8:
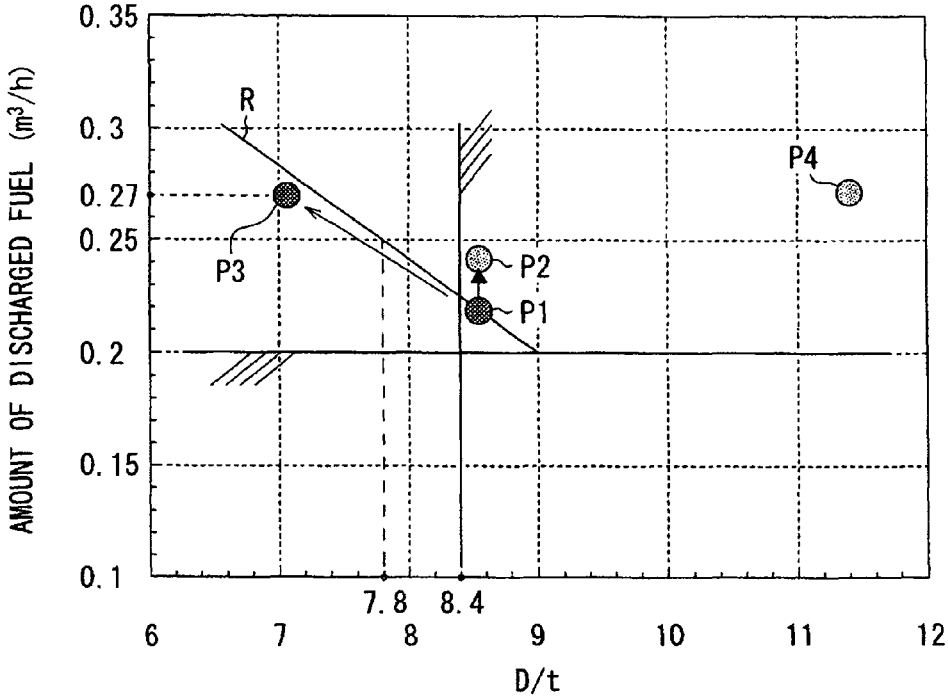
FIG. 8 is a graph showing a relationship between an amount of discharged fuel and a value of (D/t) in the fuel pump according to the fifth embodiment of the present invention.

FIG. 8 shows data comparing the amount of fuel discharged from various fuel pumps produced experimentally by the inventors of the present invention.

Inventors produced a first prototype fuel pump which is different from the one described in the fifth embodiment. In the first prototype, the thickness t1 of the impeller is approximately 3.8 mm, and the outside diameter D1 of the impeller is 32.5 mm. Therefore, the value of (D1)/(t1) is approximately 8.6. This value does not satisfy the condition of the fifth embodiment, that is, the value of D/t is equal to or less than 8.4. The inventors measured the amount of fuel discharged from the first prototype under the condition that rotating velocity of the impeller is 7000 rpm As a result, the inventors got a first test result (corresponding to reference letter P1 in FIG. 8) that the amount of fuel discharged from the first prototype is 0.22 $m^3/h$.

Next, inventors produced a second prototype fuel pump (shown in FIG. 7B) similar to the first prototype. In the second prototype, the distances L1, L2 are longer than the corresponding distances in the first prototype, so that the amount of discharged fuel will increase. The outside diameter 12 of the impeller 30E is the same as the outside diameter D1 of the first prototype. Similarly, the thickness t2 of the impeller 30E is the same as the thickness t1 of the first prototype. Therefore, the value of (D2)/(t2) is approximately 8.6, and does not satisfy the condition of the fifth embodiment. The inventors measured the amount of fuel discharged from the second prototype under the same condition applied in the first prototype. As a result, inventors got a second test result (corresponding to reference letter P2 in FIG. 8) that the amount of fuel discharged from the second prototype is 0.24 $m^3$/h.

Moreover, the inventors produced a third prototype fuel pump similar to the first prototype, but having the structure described in the fifth embodiment (shown in FIG. 7A) In the third prototype, the impeller 30D is thicker than in the first prototype, so that the amount of discharged fuel increases. The outside diameter D3 of the impeller 30D is the same as the outside diameter D1 of the first prototype. Provided the thickness of the impeller 30D of the third prototype is defined as t3, the value of (D3)/(t3) is approximately 7.1. This value satisfies the condition of the fifth embodiment. The distances L1, L2 are the same as the corresponding distances in the first prototype. With this structure, the cross sections both of the casing-side passage and of the cover-side passage are the same in the third prototype and in the second prototype. The inventors measured the amount of fuel discharged from the third prototype under the same condition applied in the first and second prototypes As a result, the inventors got a third test result (corresponding to reference letter P3 in FIG. 8) that the amount of fuel discharged from the third fuel pump is 0.27 $m^3$/h.

Comparing the second prototype with the third prototype, the amount of fuel discharged from the third prototype is larger than that discharged from the second prototype, even though the cross sections of both the casing-side passage and the cover-side passage are the same for the third prototype and the second prototype. This comparison shows that the increase in the amount of discharged fuel results from the position of the axis of rotation of circulating flow in each prototype. Specifically, the amount of fuel discharged from the third prototype is larger, because the axes of rotation C1, C2 of circulating flow 300D,301D in the third prototype are positioned within the blade ditches 34D,35D, as described above and shown in FIG. 7A. Compared with this, the axes of rotation C10, C20 of circulating flow 300E,301E in the second prototype are positioned outside of the blade ditches 34E,35E, as shown in FIG. 7B.

In addition, the inventors produced various prototype fuel pumps similar to the second prototype. In this case, the outside diameter of the impellers of each of the various prototypes was changed variously from the outside diameter of the second prototype. The other sizes of the fuel pump and experimental conditions are not changed Consequently, when the outside diameter of the impeller is set at 43 mm, the fourth prototype fuel pump discharges the same as the amount of fuel discharged from the third prototype (corresponding to reference letter P4 in FIG. 8). Incidentally, inventors analyzed the amount of discharged fuel from various prototypes similar to the third prototype. Specifically, prototypes similar to the third prototype have various thicknesses of each impeller. In this case, the axes of rotation of various prototypes are positioned within blade ditches of the impeller. The analysis result is shown as a solid line R drawn in FIG. 8.

In the fifth embodiment, in view of the above-described test results, the distance L1, L2 from the center of the impeller with respect to the thickness direction to the bottoms of the fuel passages and the thickness t of the impeller are set to satisfy the condition expression that the value of t/2 is equal to or more than both (L1)/2 and (L2)/2, respectively. With this structure, the cover-side axis C1 and the casing-side axis C2 are positioned within blade ditches 34D,350 of the impeller 30D, as shown in FIG. 7A. Moreover, the thickness t is set to satisfy the condition expression that the value of D/t is equal to or less than 8.4. With this structure, the cross section of the fuel passage is enlarged compared to the one of the first prototype. Accordingly, this structure can prevent the decrease in the discharge efficiency of the fuel pump, and at the same time, can increase the amount of fuel discharged from the fuel pump compared to the one of the first prototype.

In the fifth embodiment, the impeller 30D has an annular portion 32D which is positioned outside of the blades and blade ditches 34D,35D and is connected the outer edge of the blades. However, an impeller which does not have the above annular portion 32D may be used.

In addition, the pump section 12D described in the fifth embodiment is suitable for use with the fuel pump that includes an impeller whose outside diameter is equal to or less than 34 μm.

Furthermore, it is desired that the thickness t is set to satisfy the condition expression that the value of D/t is equal to or less than 7.8, so that the amount of fuel discharged from the fuel pump can be equal to or more than 0.25 $m^3$/h when the rotating velocity of the impeller is in a range of 6000-8000 rpm. The pump section 12D described in the fifth embodiment is suitable for use with the fuel pump that discharges high fuel flow (e.g. the amount of discharged fuel is equal to or more than 0.25 $m^3$/h) because the pump section 12D described in the fifth embodiment achieves prominent effect of preventing the decrease in the discharge efficiency.

(Variation)

In the above embodiments, fuel passages are disposed axially on both sides of the impeller. However, a fuel passage may be disposed axially on one side of the impeller.

Various other modifications and alternations may be made to the above embodiments without departing from the spirit of the present invention. Thus, while the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel pump comprising;

a rotatable impeller having a plurality of blades and blade ditches on the periphery thereof;

a motor section for driving the impeller; and a casing member which accommodates the impeller and has at least one fuel passage along an outer periphery of the impeller;

wherein:

the fuel passage communicates with the blade ditches;

a distance along an inner surface from a centerline at a bottom of the fuel passage to a radially inside edge of the fuel passage, with respect to an axis of rotation of the impeller, is shorter than a distance from said centerline to a radially outside edge of the opening of the fuel passage, diametrically opposite said inside edge;

two fuel passages are provided, one disposed axially on each side of the impeller;

an outside diameter D of the impeller and a thickness t of the impeller are set to satisfy the condition expression that the value of D/t is equal to or less than 8.4; and distances L1, L2 from the center of the impeller with respect to the thickness direction to the bottoms of the fuel passages and the thickness t of the impeller are set to satisfy the condition expression that the value of t/2 is equal to or more than both (L1)/2 and (L2)/2.

2. The fuel pump according to claim 1, wherein:

the fuel passage is a groove having a concave inner surface with respect to the impeller.

3. The fuel pump according to claim 2, wherein:

a continuously curved surface is formed at the bottom side of a radially inside sidewall of the fuel passage.

4. The fuel pump according to claim 3, wherein:

the radially inside sidewall is orthogonal to an outer surface of the impeller at the radially inside edge of the fuel passage.

5. The fuel pump according to claim 2, wherein:

an inclined surface is formed at the bottom side of a radially inside sidewall of the fuel passage.

6. The fuel pump according to claim 5, wherein:

the radially inside sidewall is orthogonal to an outer surface of the impeller at the radially inside edge of the fuel passage.

7. The fuel pump according to claim 1, wherein:

a rotating velocity of the impeller is in a range of 6000-8000 rpm; and an amount of fuel discharged from the fuel pump can be equal to or more than 0.2 $m^3/h$.

8. The fuel pump according to claim 1, wherein:

a rotating velocity of the impeller is in a range of 6000-8000 rpm; an amount of fuel discharged from the fuel pump can be equal to or more than 0.25 $m^3/h$; and the outside diameter D of the impeller and the thickness t of the impeller are set to satisfy the condition expression that the value of D/t is equal to or less than 7.8.

9. The fuel pump according to claim 1, wherein:

the outside diameter D of the impeller is equal to or less than 34 mm.

10. A fuel pump comprising;

a rotatable impeller having a plurality of blades and blade ditches on the periphery thereof;

a motor section for driving the impeller; and a casing member which accommodates the impeller and has two fuel passages along an outer periphery of the impeller;

wherein:

the two fuel passages are disposed axially on both sides of the impeller, respectively;

an outside diameter D of the impeller and a thickness L of the impeller are set to satisfy the condition expression that the value of D/t is equal to or less than 8.4;

distances L1, L2 from the center of the impeller with respect to the thickness direction to the bottoms of the fuel passages and the thickness t of the impeller are set to satisfy the condition expression that the value of t/2 is equal to or than both (L1)/2 and (L2)/2;

a rotating velocity of the impeller is in a range of 6000-8000 rpm;

an amount of fuel discharged from the fuel pump can be equal to or more than 0.25 $m^3/h$; and the outside diameter D of the impeller and the thickness t of the impeller are set to satisfy the condition expression that the value of D/t is equal to or less than 7.8.

11. The fuel pump according to claim 10, wherein:

the outside diameter D of the impeller is equal to or less than 34 mm.

* * * * *